US006508236B2

(12) United States Patent
Amou et al.

(10) Patent No.: US 6,508,236 B2
(45) Date of Patent: Jan. 21, 2003

(54) FUEL SUPPLY DEVICE AND INTERNAL COMBUSTION ENGINE MOUNTING THE SAME

(75) Inventors: Kiyoshi Amou, Chiyoda (JP); Yoshio Okamoto, Minori (JP); Takehiko Kowatari, Kashiwa (JP); Ayumu Miyajima, Narita (JP); Yuzo Kadomukai, Ishioka (JP); Toru Ishikawa, Kitaibaraki (JP); Masami Nagano, Hitachinaka (JP); Takanobu Ichihara, Hitachinaka (JP); Hiroaki Saeki, Hitachinaka (JP); Kenji Watanabe, Hitachinaka (JP)

(73) Assignees: Hitachi, Ltd., Tokyo (JP); Hitachi Car Engineering Co., Ltd., Hitachinaka (JP)

( * ) Notice: Subject to any disclaimer, the term of this patent is extended or adjusted under 35 U.S.C. 154(b) by 8 days.

(21) Appl. No.: 09/819,639

(22) Filed: Mar. 29, 2001

(65) Prior Publication Data

US 2001/0025628 A1 Oct. 4, 2001

(30) Foreign Application Priority Data

Mar. 29, 2000 (JP) ..... 2000-095224

(51) Int. Cl.[7] ..... F02M 31/02; F02N 17/02; B05B 7/06

(52) U.S. Cl. ..... 123/545; 123/179.21; 123/179.7; 123/549; 123/585; 239/424

(58) Field of Search ..... 123/179.21, 179.7, 123/491, 545, 549, 585, 568.11, 568.21; 239/8, 423, 424

(56) References Cited

U.S. PATENT DOCUMENTS 5,482,023 A 1/1996 Hunt et al. ..... 123/491
6,116,516 A * 9/2000 Ganan-Calvo ..... 239/423 X

* cited by examiner

*Primary Examiner*—Tony M. Argenbright
(74) *Attorney, Agent, or Firm*—Antonelli, Terry, Stout & Kraus, LLP

(57) ABSTRACT

Atomizing air flowing in an atomizing gas passage is merged with a fuel spray to promote atomization of the fuel, and carrier air flowing in a carrier gas passage is merged with the fuel spray at a further downstream position so as to surround the fuel spray. By doing so, the atomized fuel spray is carried to the downstream side so as to prevent the fuel spray from adhering onto the wall surface. The starting-up performance, fuel consumption and exhaust gas cleaning of an internal combustion engine are improved in this way.

10 Claims, 6 Drawing Sheets

FUEL SUPPLY DEVICE AND INTERNAL COMBUSTION ENGINE MOUNTING THE SAME

BACKGROUND OF THE INVENTION

The present invention relates to a fuel supply device for an internal combustion engine of a vehicle, such as an automobile, and to an internal combustion engine using such a fuel supply device; and, more particularly, the invention relates to a technology suitable for improving the start-up performance of an internal combustion engine and for reducing the amount of harmful substances, particularly HC, emitted from an internal combustion engine.

As a means for improving the start-up performance and improving the fuel consumption and for reducing harmful substances, particularly HC, produced in an internal combustion engine, it is effective to atomize the fuel injected from a fuel injector and to reduce the amount of fuel adhering on an inner surface of the intake pipe. Further, an improved stability of combustion can be attained by sufficiently atomizing the fuel spray. It is known to use an auxiliary fuel injector during starting operation of an internal combustion engine in order to provide a supply of atomized fuel spray to the internal combustion engine. A cold-start fuel control system comprising a cold-start fuel injector, a heater and an idle speed control valve (hereinafter, referred to as ISC valve) is disclosed in the specification and drawings of U.S. Pat. No. 5,482,023.

In this system, a part of the air from the ISC valve (a first air flow) is merged with fuel injected from the cold-start fuel injector. For this purpose, the opening of the air flow passage from the ISC valve is arranged to have an annular shape so as to surround an outlet portion of the cold-start fuel injector. The fuel from the cold-start fuel injector, just after merging with the first air flow, will enter into a cylindrical heater arranged downstream of the cold-start fuel injector.

On the other hand, an air passage for allowing part of the air from the ISC valve to flow therethrough is formed in an outer periphery of the heater, and the air flowing through this air passage (a second air flow) merges with the fuel spray that has passed through the inside of the heater at the outlet portion of the heater. The atomization of the fuel coming out from the cold-start fuel injector is promoted so that the fuel is vaporized while passing through the inside of the heater, and atomization is further promoted as the fuel is vaporized by being mixed with the second air flow at the outlet portion of the heater.

In the conventional system, a mixing chamber for mixing the fuel and the air inside a cylindrical heater is provided to form a kind of atomizer having a heater outlet as the fuel outlet. In the cold-start fuel injector, the merging point of the fuel injected from the cold-start fuel injector with the air flow and the mixing chamber constructed inside the heater are arranged in a row from the upstream side. It can be considered that the atomizer is an air assist type atomizer, which uses the energy of the air flow, and is also an internal mixing type atomizer, which performs air-liquid mixing by merging the fuel with the air inside the atomizer.

In the above-described system, the fuel spray is always in contact with the inner wall surface of the mixing chamber, that is, the inner wall surface of the heater, while the fuel is being injected. Therefore, the burden on the heater of atomizing the fuel spray becomes large and the consumed electric power also becomes large.

SUMMARY OF THE INVENTION

An object of the present invention is to provide a fuel supply device and an internal combustion engine mounting such a fuel supply device, in which it is possible to reduce the electric energy consumed in the heater in order to promote atomization of a fuel spray injected from a liquid fuel injector, or to eliminate the heater in some cases.

Another object of the present invention is to provide a fuel supply device and an internal combustion engine mounting such a fuel supply device, in which it is possible to improve the reliability and the durability of a heater by reducing the electric energy consumed by the heater.

According to the present invention, a fuel supply device comprises a fuel atomizing device for atomizing fuel into a spray injected from a liquid fuel injector by the action of a gas, the atomized fuel spray being supplied downstream of a throttle valve in an intake pipe in which the throttle valve is mounted, wherein the fuel supply device comprises a first gas passage for jetting atomizing gas which acts on the fuel spray injected from a liquid fuel injection hole of the fuel injector to promote atomization of the fuel spray, the first gas passage being opened around the liquid fuel injection hole; a second gas passage for generating a mixed gas by jetting a carrying gas to the fuel spray so as to surround the fuel spray in which atomization is promoted by the atomizing gas; and a heater disposed so as to be positioned in the periphery of a passage carrying the mixed gas.

By doing so, since the atomizing gas promotes atomization of the fuel spray and the atomization-promoted fuel spray is carried so as to be surrounded by the carrying gas, the burden of the heater is reduced and the amount of fuel adhering on the wall surface is reduced.

DESCRIPTION OF THE PREFERRED EMBODIMENTS OF THE INVENTION

A first embodiment of a fuel supply device and an internal combustion engine mounting a fuel supply device according to the present invention will be described below with reference to FIG. 1 to FIG. 4. The first embodiment uses intake air as an atomizing gas for promoting atomization of the fuel spray and also as a carrier gas for carrying the atomized fuel spray.

Figure 1:
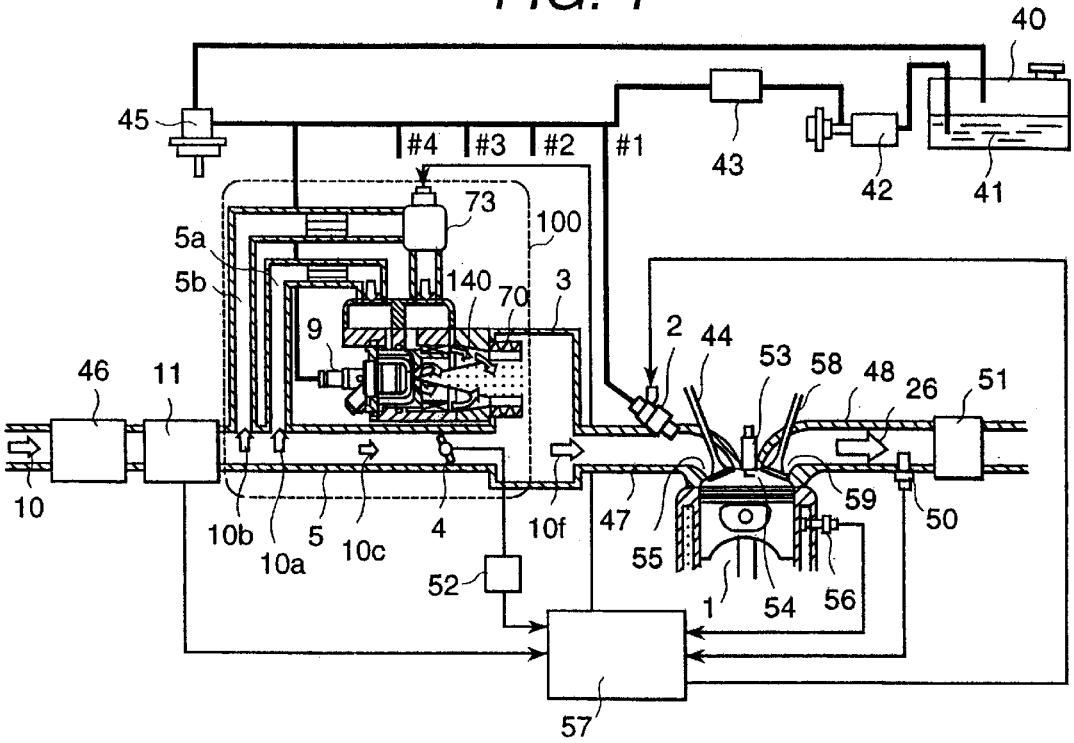
FIG. 1 is a schematic block diagram showing a first embodiment of an internal combustion engine mounting a fuel supply device in accordance with the present invention.

FIG. 1 is a schematic block diagram showing the first embodiment of an internal combustion engine mounting a fuel supply device in accordance with the present invention, which is an ignition type internal combustion engine and is operated using gasoline as the fuel.

An internal combustion engine 1 comprises a combustion chamber 54 having an ignition plug 53 extending into the combustion chamber 54; an intake opening 55 for introducing a mixture of air and fuel into the combustion chamber 54; an intake valve 44 for opening and closing the intake opening 55; an exhaust opening 59 for exhausting gas after it is burned; and an exhaust valve 58 for opening and closing the exhaust opening 59.

The internal combustion engine 1 further comprises a water temperature sensor 56 for detecting the temperature of the engine cooling water in a side portion of the combustion chamber 54 to detect an operating condition of the engine, and a rotation sensor (not shown in figure) from which the speed of operation and timing of the internal combustion engine 1 can be detected.

An intake system for supplying air to the combustion chamber 54 comprises an air cleaner 46; an air flow sensor 11; a throttle valve 4 and throttle sensor 52 composing an intake control unit; and an intake pipe 5. The intake pipe 5 includes an intake assembling pipe 3 and an intake manifold 47 connected to the intake opening 55. The intake manifold 47 is branched to a plurality of cylinders from the intake assembling pipe 3, but FIG. 1 illustrates only one cylinder portion.

A fuel supply device for supplying fuel to the internal combustion engine 1 in this embodiment according to the present invention comprises a first fuel supply device and a second fuel supply device. The first fuel supply device is composed of a first liquid fuel injector 2, which is arranged at a position upstream of each of the intake valves 44 of the cylinders and downstream of the intake assembling pipe 3. The first liquid fuel injector 2 injects fuel toward the upstream side of the intake valve 44, which is disposed in a wall portion of the intake manifold 47 to open and close the intake opening 55.

The second fuel supply device 100 is arranged in the upstream side of the intake assembling pipe 3 in the intake system. The second fuel supply device 100 comprises the intake pipe 5 containing the throttle valve 4; intake bypass pipes 5*a*, 5*b* branched from the intake pipe 5 upstream of the throttle valve 4; an ISC valve 73 arranged in a middle portion of the intake bypass pipe 5*b*; and a second liquid fuel injector 9 for injecting fuel to the cylinders in common.

In the illustrated arrangement, the atomization of the fuel spray 6 injected from the second liquid fuel injector 9 is promoted by the air which has passed through the intake bypass pipes 5*a*, 5*b* to produce a mixed gas to be supplied to the intake assembling pipe 3. The intake bypass pipes 5*a*, 5*b* may be formed in one common pipe in the upstream portion and branched in a middle portion (in the downstream portion). The second fuel supply device 100 mainly functions to supply fuel during warming-up idling operation, during which the amount of fuel supply is controlled by the second liquid fuel injector 9, and the amount of intake air is controlled by the ISC valve 73.

The first liquid fuel injector 2 is arranged at the wall portion of the intake manifold 47 and injects fuel in the direction toward the intake valve 44. The second liquid fuel injector 9 is operated for a predetermined time period during warming-up operation of the internal combustion engine 1. Each of the first and the second liquid fuel injectors 2, 9 is formed by an electromagnetic type fuel injection valve, and each injector controls the amount of injected fuel in accordance with the time periods of opening and closing of a valve seat by a valve member inside the fuel injector. The control of the amount of injected fuel is performed by an engine control unit (hereinafter, referred to as ECU) corresponding to the operating condition, such as the amount of intake air detected from a signal from the air flow sensor 11.

Further, each of the first and the second liquid fuel injectors 2, 9 is a fuel injection valve of the upstream swirl type, and comprises a member (fuel swirl member) for adding a swirl force to the fuel on the upstream side of the valve seat, so as to inject fuel while adding a swirl to the fuel passing through a liquid fuel injection hole arranged in the downstream side of the valve seat. By doing so, a cone-shaped and superior atomized fuel spray is formed.

The amount of intake air supplied to the internal 15 combustion engine 1 is accurately measured using the air flow sensor 11, the throttle valve 4, the throttle valve sensor 52, the ISC valve 73 and so on. The throttle valve 4 is an intake air control member for varying the amount of air flowing inside the intake pipe 5 by being rotated inside the intake pipe 5 to vary the air flow passage area projected on the cross section of the intake pipe 5.

The exhaust system comprises an exhaust manifold 48; an oxygen concentration sensor 50 for measuring the oxygen concentration in the exhaust gas; a ternary catalyst converter 51 for exhaust gas cleaning; and a dissipative muffler (not shown in figure) and so on.

The ternary catalyst converter 51 purifies, with a high purification rate, NOx, CO and HC exhausted from an internal combustion engine 1 operated under a condition near the stoichiometric air-fuel ratio.

Prior to starting up the internal combustion engine 1, the fuel supply system pressurizes the fuel (gasoline) 41 in the fuel tank 40 using a fuel pump 42 to pump the fuel to the first fuel injector 2 and the second fuel injector 9 with a preset pressure through a filter 43. The fuel pressure is regulated by a pressure regulator 45 so that a pressure difference relative to the pressure of the intake pipe may become constant.

In the construction described above, a mixed gas consisting of the fuel injected from the first and the second liquid fuel injectors 2, 9 and the intake air 10 is sucked into the combustion chamber 54 in the intake stroke, and the sucked mixed gas is compressed in the compression stroke and then ignited by the ignition plug 53 so as to be burned in the combustion stroke. The exhaust gas 26 exhausted from the internal combustion engine 1 in the exhaust stroke is discharged to atmosphere through the exhaust system.

Figure 2:
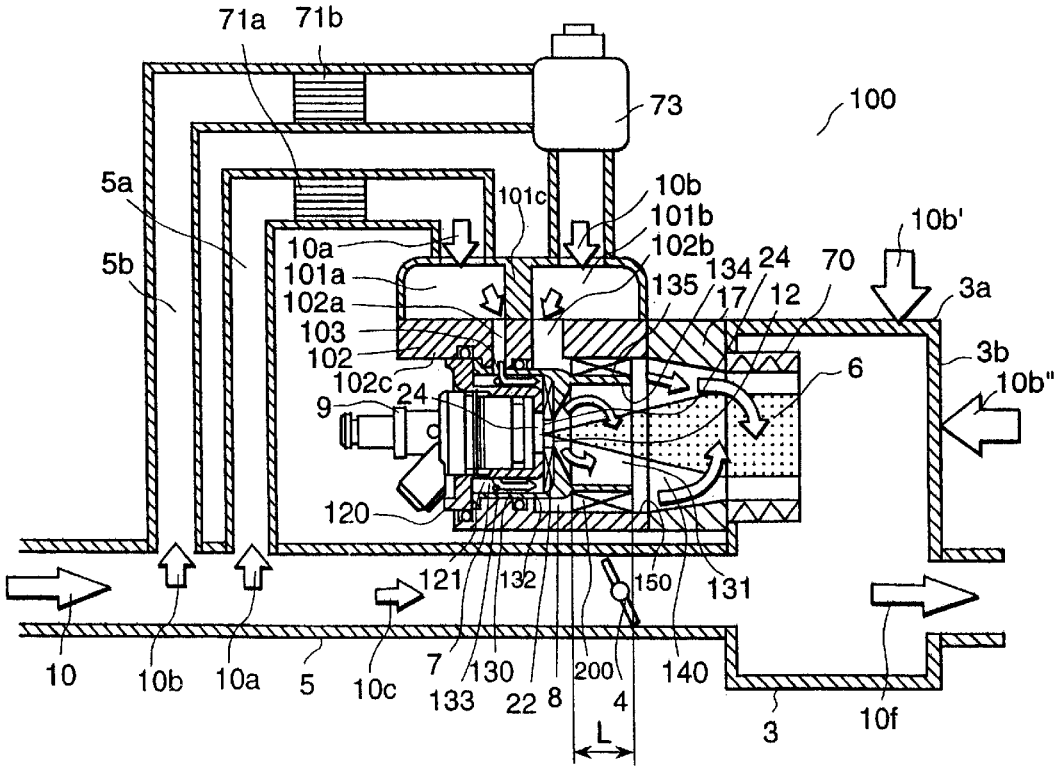
FIG. 2 is an enlarged cross-sectional side view showing the fuel supply device shown in FIG. 1.

The construction of the second fuel supply device 100 will be described below in detail with reference to FIG. 2. FIG. 2 is an enlarged longitudinal cross-sectional side view showing the fuel supply device 100.

One end of the intake bypass pipe 5*a* is connected to a pressure regulation chamber 101*a* to supply the intake air 10*a* to the pressure regulation chamber 101*a* as atomizing air. The ISC valve 73 is located at a position in the middle of the intake bypass pipe 5*b*. The position in the middle of the intake bypass pipe 5*b* may include the inlet portion or the outlet portion, and accordingly, for example, the ISC valve 73 may be arranged between the outlet portion (the end portion on the downstream side) of the intake bypass pipe 5*b* and the pressure regulation chamber 101*b*. The end portion of the intake bypass pipe 5*b* on the downstream side is connected to (communicated with) the pressure regulation chamber 101*b* to supply the intake air 10*b* to the pressure regulation chamber 101*b* as carrier air. The pressure chambers 101*a* and 101*b* are separated from each other by an isolation wall 101*c*.

An atomizer base member 102 is connected downstream and forms a bottom portion of the pressure chambers 101*a* and 101*b*. In this embodiment according to the present invention, the atomizer base member 102 is formed in a cylindrical shape, and a cylindrical orifice member 17 and a heater 70 are connected in series downstream thereof to form a mixed gas generating chamber 140 with the atomizer base member 102.

The atomizer base member 102 comprises an atomizing gas passage 102*a* and a carrier gas passage 102*b*, and the pressure regulation chambers 101*a* and 101*b* are in communication, respectively, with the atomizing gas passage 102*a* and the carrier gas passage 102*b*. The atomizer base member 102 comprises a fuel injector accommodating hole 102*c* communicating with the upstream side of the mixed gas generating chamber 140; and, in the fuel injector fitting hole 102*c*, a gas-liquid mixture injection nozzle 130, an injector holder 120 and the second liquid fuel injector 9 are concentrically fit so as to be arranged in this order.

The atomizing gas passage 102*a* is in communication with a nozzle passage 103 arranged in the gas-liquid mixture injection nozzle 130. The nozzle passage 103 is in communication with an atomizing gas passage 7 in the form of an annular gap which is formed by an inner wall surface (an inner peripheral surface) 133 of the gas-liquid mixture injection nozzle 130, an outer wall surface (an outer peripheral surface) 121 of the injector holder 120 and a front end surface 24*a* of a liquid injecting nozzle 24 of the liquid fuel injector 9.

The front end surface 24*a* of the liquid injecting nozzle 24 has a liquid fuel injection hole (not shown in the figure), and by using the front end surface 24*a* as a part of the passage wall of the atomizing gas passage 7, the opening of the atomizing gas passage 7 is brought close to the fuel injection hole of the liquid fuel injector 9 so that the intake air 10*a* for atomization may effectively act on the beginning end portion of the fuel spray 6 injected from the liquid fuel injector 9.

Further, as will be described later, when a swirl force is imparted to the sprayed fuel inside the liquid fuel injector 9, the radius of the swirl of the fuel spray 6 becomes larger as the distance from the fuel injection hole of the liquid fuel injector 9 is increased. Therefore, since the atomizing gas passage 7 is opened by bring it close to the fuel injection hole along the front end surface 24*a* of the liquid injection nozzle 24 of the liquid fuel injector 9, the length of the atomizing gas passage 7 in the radial direction can be made longer, and, consequently, it is advantageous in that it will give a directional property to the atomizing air flow.

Further, since size of the gas-liquid mixture injection hole 12 of the gas-liquid mixture injection nozzle 130 following the atomizing gas passage 7 can be decreased, the freedom of design relative to the dimensions of the parts other than the gas-liquid mixture injection hole 12 can be increased in proportion to the decreased amount of the size.

The gas-liquid mixture injection hole 12 is bored at a position opposite to the front end surface 24*a* of the liquid fuel injector 9 in the gas-liquid mixture injection nozzle 130, and the downstream end of the atomizing gas passage 7 is in communication with the inside of the inner wall surface (the inner peripheral surface) of a cylindrical guide 131 extending toward the downstream side from the gas-liquid mixture injection nozzle 130 through the gas-liquid mixture injection hole 12 from the opening.

The gas-liquid mixture injection hole 12 is a thin edge orifice so that the length of the parallel portion of the gas-liquid mixture injection hole 12 in the flow direction of the fuel spray 6 and the atomizing gas 10*a* flowing in the gas-liquid mixture hole 12 is made as short as possible. Further, the gas-liquid mixture injection hole 12 is formed to have a shape such that a cross-sectional area of the passage is enlarged toward the downstream side, and it is connected to the inner wall surface (the inner peripheral surface) 134 of the guide 131 at the enlarged side. The guide 131 is formed to have a shape such that both the inner peripheral surface 134 and the outer peripheral surface 135 of the guide 131 are parallel to the flow direction and have a predetermined length L.

The carrier gas passage 102*b* is communicated with a carrier gas passage 8 which is in the form of an annular gap formed by the inner wall surface (an inner peripheral surface) 150 of the atomizer base member 102, a part of the outer wall surface 132 of the gas-liquid mixture injection nozzle 130 and the outer wall surface 135 of the guide 131.

The atomizing gas passage 102*a* and the carrier gas passage 102*b* are merged with each other at the upstream end of the orifice 17, which is connected to the downstream end of the atomizer base member 102 through the annular gaps of the atomizing gas passage 7 and the carrier gas passage 8, respectively. The orifice 17 is formed to have a reducing shape such that the cross sectional area of the passage is decreased toward the downstream side. At the downstream end of the orifice 17, a cylindrical heater 70, forming a continuation of the passage of the fuel spray inside of the cylindrical heater 70, is connected to the orifice 17. The heater 70 is arranged so that the outlet of the heater 70 may be in communication with the inside of the intake assembling pipe 3.

The parts described above basically make up a fuel atomizer which effectively produces and transports (supplies) a mixed gas to the downstream side by atomizing the fuel spray 6 injected from the liquid fuel injector 9 and by mixing gas and liquid using the atomizing air 10*a*, the carrier air 10*b* and the heater 70.

Next, the flow of the intake air 10 will be described. Referring to FIG. 1 and FIG. 2, as the internal combustion engine 1 is rotated, the inside of the intake pipe 5, including the intake assembling pipe 3, becomes a predetermined negative pressure. The intake air 10 sucked from the outside by the negative pressure inside the intake pipe 5 is filtered as it passes through the air cleaner 46, and then the amount of the intake air 10 is measured by the air flow sensor 11 and reaches the upstream side of the throttle valve 4. At the time of the starting operation and during idling operation, almost all of the intake air 10 flows into the intake bypass pipes 5*a*, 5*b* as atomizing air 10*a* and carrier air 10*b*, respectively, and reaches the ISC valve 73.

The ISC valve 73 controls the flow rate of the carrier air 10*b* flowing through the intake bypass pipe 5*b*. At the time of the starting operation and during idling operation of the internal combustion engine 1, the flow rate of the necessary intake air 10 is controlled by the ISC valve 73 because the throttle valve 4 is closed (in fully closed state). Further, the flow rate of the carrier air 10*b* is very large compared to the flow rate of the atomizing air 10*a*, and can sufficiently supply the flow rate of the intake air necessary for the starting operation and during idling operation. Therefore, by controlling the flow rate of the carrier air 10*b* without controlling the flow rate of the atomizing air 10*a*, the idling operation of the internal combustion engine 1 can be carried out.

A part of the intake air 10 flows into the combustion chamber 54 as the intake air 10*c* by leaking through a very small gap between the throttle valve 4 and the intake pipe 5 even when the throttle valve 4 is in the fully closed 20 state. However, the mount of the intake air 10*c* is negligibly small compared to the amount of atomizing air 10*a* and the amount of carrier air 10*b*.

Although each of the intake bypass pipes 5*a* and 5*b* in this embodiment according to the present invention is branched from the intake pipe 5, these passages may be integrated to form a single passage, and not be independently separated. In that case, the isolation wall 101*c* separating the pressure regulation chambers 101*a* and 101*b* is eliminated to form a single pressure regulation chamber. By doing so, the atomizing gas passage 102*a* and the carrier gas passage 102*b* will be in communication with the same pressure regulation chamber. Further, in such a modified arrangement, the ISC valve 73 will be disposed in the middle of the integrated intake bypass pipe. The position in the middle of the intake bypass pipe may include the inlet portion or the outlet portion, and, accordingly, for example, the ISC valve 73 may be arranged between the outlet portion (the end portion in the downstream side) of the intake bypass pipe and the pressure regulation chamber.

In this embodiment according to the present invention, the construction of the intake bypass pipes 5*a*, 5*b* and the installing position of the ISC valve 73 are determined so that the pressure of the atomizing air 10*a* at the time of the starting operation and during the idling operation may be maintained at a preset pressure. In the case where the intake bypass pipes 5*a*, 5*b* are integrated into a single bypass pipe, there are some cases where the carrier air 10*b* and the atomizing air 10*a* are not supplied under a normal condition to the carrier gas passage 8 and the atomizing gas passage 7 by the intake air flow rate control of the ISC valve 73. However, in this embodiment according to the present invention, the carrier air 10*b* is flow controlled by the ISC valve 73, but the atomizing air 10*a* can be supplied under a normal condition because the atomizing air 1 10*a* is not controlled. Therefore, the atomizing air 10*a* effectively acts on the fuel spray to stabilize the promotion of atomization.

The flow of the intake air 10*a* downstream of the ISC 5 valve 73 will be described. The intake air 10*b* controlled by the ISC valve 73 flows into the pressure regulation chamber 101*b* which has a predetermined space. The intake air 10*b* entering into the pressure regulation chamber 101*b* mainly flows into the carrier gas passage 102*b* as carrier air 10*b*, having a role of transporting the fuel spray 6 downstream. The splitting (divided) flow ratio between the atomizing air 10*a* and the carrier air 10*b* is determined by the ratio of the passage cross sectional areas of the gas-liquid mixture injection hole 12 provided in the gas-liquid injection nozzle 130 and the carrier gas passage 102*b*.

In the case where the intake bypass pipes 5*a*, 5*b* are integrated into a single bypass pipe, the intake air controlled by the ISC valve 73 flows into the single pressure regulation chamber having a predetermined space and is split between the atomizing gas passage 102*a* and the carrier gas passage 102*b* to form the atomizing air 10*a* and the carrier air 10*b*, respectively. Therein, the splitting flow ratio between the atomizing air 10*a* and the carrier air 10*b* in this case is also determined by the ratio of the passage cross sectional areas of the gas-liquid mixture injection hole 12 provided in the gas-liquid injection nozzle 130 and the carrier gas passage 102*b*.

The atomizing air 10*a* flows into the atomizing gas passage 7 through the nozzle passage 103. The atomizing air 10*a* flowing in the atomizing gas passage 7 is supplied (emerged) so as to uniformly surround the whole periphery of the beginning end portion of the fuel spray 6 along the front end surface 24*a* of the liquid injection nozzle 24, as shown by the arrow in FIG. 2 and then passes through the gas-liquid mixture injection hole 12 so as to be injected into the guide 131 downstream of the gas-liquid mixture injection nozzle 130.

The fuel spray 6 is efficiently supplied into the mixture generating chamber 140 without adhering onto the gas-liquid mixture injection hole 12 by the gas-liquid mixture injection nozzle 130 and the shape of the gas-liquid mixture injection hole 12, and this is further accomplished by supplying the atomizing air 10*a* with an appropriate velocity and an appropriate flow rate so that the atomizing air 10*a* may uniformly surround the whole periphery of the beginning end portion of the fuel spray 6. Then, the atomizing air 10*a* and the fuel spray 6 supplied to the mixed gas generating chamber 140 proceed to the orifice 17 through the guide 131. During that period, the atomizing air 10*a* promotes further atomization and gas-liquid mixing of the fuel spray 6 by merging with the fuel spray 6.

The carrier air 10*b* is supplied from the carrier gas passage 102*b* to the carrier gas passage 8 of the annular gap, and then it is supplied from the rear end of the outer periphery of the guide 131 to the mixed gas generating chamber 140, from which it flows to the orifice 17 so as to surround the atomization promoted fuel spray 6 and the atomizing air 10*a* around the outer periphery.

The velocity of the fuel spray 6 and the atomizing air 10*a* and the carrier air 10*b*, which are merged while being contracted by the orifice 17, is increased because the cross-sectional area of the orifice 17 becomes smaller in the downstream direction so as to improve the restricting action and the ability to carry the fuel spray 6. Therefore, the fuel spray 6, the atomization and the gas-liquid mixing of which are promoted by the atomizing air 10*a*, is carried by the carrier air 10*b* so as to be surrounded by the carrier air 10*b* around the whole periphery. Therefore, the amount of fuel which tends to adhere onto the wall surfaces in the various portions can be reduced, and substantially all of the fuel can be supplied into the cylindrical heater 70.

There are large sized droplets in the fuel spray 6 of which the atomization and the mixing have been promoted. The large sized droplets tend to drop down and adhere onto the wall surface of the intake pipe on the way without being transferred up to the combustion chamber 54 along the flow of the intake air (the atomizing air 10*a* and the carrier air 10*b*). In other words, the large sized droplets have a short traveling distance. As a countermeasure to this problem, the large sized droplets are caused to collide against the heater 70 or pass through the heater 70 to promote atomization and vaporization of the large sized droplets. By doing so, the amount of the fuel spray which adheres onto the inner wall surface of the intake pipe is reduced.

The effect of the length L of the guide 131 of the gas-liquid mixture injection nozzle will be described. The fuel spray 6 injected from the liquid fuel injector 9 of the upstream swirl type is in the form of a cone-shaped spray, the atomization of which is promoted as it goes toward the downstream side. By making the length L of the guide 131 longer, the outlet for the carrier air 10*b* (the carrier gas passage 8) into the mixed gas generation chamber 140 can be brought closer to the downstream portion where the atomization of the fuel spray 6 is further promoted. Therefore, the carrier air 10*b* can be efficiently supplied into the mixed gas generation chamber 140 at a predetermined speed, and the carrying power to the fuel spray 6 can be increased, so that the fuel spray 6 can be transported further downstream.

In addition, since the distance between the outlet for the carrier air 10*b* into the mixed gas generation chamber 140 is increased by shortening the length L of the guide 131, the supplying speed of the carrier air 10*b* supplied to the fuel spray 6 is decreased so as to decrease the carrying power to the fuel spray 6. However, since the flow of the carrier air 10*b* approaches close to the gas-liquid mixture injection hole 12, the effect of dragging the atomizing air 10*a* and the fuel spray 6 which has passed through the gas-liquid mixture injection hole 12 becomes large. Because the dragging effect acts to increase the amount of the atomizing air 10*a* and to expand the liquid film portion of the fuel spray 6 just after it is injected from the liquid fuel injector 9, the atomization of the fuel spray 6 is further effectively promoted.

From the viewpoint of promoting the atomization of the fuel spray 6, it is better that the length L of the guide 131 is short, and it is preferable that the length L is zero. Therefore, since the traveling distance of the fuel spray 6 to the heater 70 can be easily changed by setting the length L of the guide 131 depending on the desired purpose, it is easy to cope with various kinds of engines.

Electric current is fed through the heater 70 at the time of the starting operation of the internal combustion engine 1, and the feeding of electric current is stopped after elapse of a preset time after the start of operation. By doing so, useless feeding of electric current to the heater 70 is eliminated to reduce the electric power consumption.

In this embodiment according to the present invention, since the atomization of the fuel spray 6 is promoted by causing the atomizing air 10*a* to collide against the fuel spray 6, heat transfer between the intake air and the fuel spray 6 is improved. Further, since the atomization of the fuel spray 6 has been promoted, most of the fuel spray 6 can flow inside the intake pipe without colliding against the heater 70, so that substantially all of the fuel will reach the combustion chamber 54. Therefore, the burden of the heater 70 is reduced, and the electric power consumption can be suppressed. That is, the electric current fed to the heater 70 can be reduced, and, accordingly, the reliability and the durability of the heater 70 and the related parts can be improved.

According to this embodiment of the present invention, since the fuel spray 6 injected into the mixed gas generation chamber 140 is efficiently atomized and in the gas-liquid mixing is vaporized, the amount of the fuel spray 6 adhering onto the wall surfaces of the orifice 17 and the heater 70 can be reduced, and, accordingly, the fuel spray 6 can be efficiently supplied into the intake assembling pipe 3. Then, the fuel spray 6 supplied to the intake assembling pipe 3 passes through the inside of the intake assembling pipe 3 and is supplied into the downstream portion of the intake pipe as intake air (the mixing gas) 10*f* to be supplied to each of the combustion chambers 54.

Since the fuel spray 6 which is highly promoted in atomization and vaporization is supplied to the combustion chamber 54, the ignition timing, that is, the ignition timing of the ignition plug 53 can be retarded compared to the normal condition while maintaining the stability of combustion. Thereby, a high-temperature exhaust gas 26, which does not act on expansion work, can be generated inside the exhaust gas manifold 48, and accordingly the ternary catalyst converter 51 can be warmed up and activated in a short time. The exhaust gas 26 arriving at the exhaust gas manifold 48 is purified by removing harmful substances, such as HC, etc., produced at the time of combustion using the activated ternary catalyst converter 51, and then it is discharged to the outside through the dissipative muffler (not shown).

The position of installation and the shape of the heater 70 are not limited to those shown in this embodiment according to the present invention, and a lattice-shaped heater may be disposed downstream of the fuel spray 6. In this case, it is possible not only to promote vaporization of the very large droplets existing in the fuel spray 6, but also to promote vaporization of the atomized fuel spray 6. A plate heater may be disposed on a wall surface at a traveling position of the fuel spray 6. Further, it is possible to promote atomizing, gas-liquid mixing and vaporizing of the fuel spray 6 by arranging heaters 71*a*, 71*b* in the intake bypass pipes 5*a*, 5*b* to heat the atomizing air 10*a* and the carrier air 10*b* passing through the intake bypass pipes 5*a*, 5*b*.

In this embodiment according to the present invention, in the case where the idling speed is controlled by controlling the opening and closing of the throttle valve 4, it is possible to construct the system so as to supply intake air through the bypass pipes 5*a*, 5*b* in the normal condition without using the ISC valve 73.

By using a liquid fuel injector 9 of the upstream swirl type, the injected fuel itself is rotated to promote atomization. Therefore, since the work of promoting the atomization by the atomizing air 10*a* can be reduced, the amount of the atomizing air 10*a* can be reduced by an amount corresponding to the reduced work on the other hand, the amount of the carrier air 10*b* can be increased by an amount corresponding to the reduced work to increase the carrying power to the fuel spray 6.

Further, in this embodiment according to the present invention, there is provided a fuel atomizing means (atomizer) inside the liquid fuel injector 9, and the atomizing air 10*a* is merged with the fuel spray 6 at the outside of the liquid fuel injector 9. That is, it can be said that the atomizing air 10*a* forms an atomizer of the external mixing type. The outlet of the liquid fuel injection hole of the liquid fuel injector 9 corresponds to the outlet of the atomizer.

The fuel spray 6 injected from the atomizer of the external mixing type (the liquid fuel injector 9) is promoted in the atomization thereof and the gas-liquid mixing under a condition not restricted by the surrounding passage walls, for example, the gas-liquid mixture injection hole 12, the inner peripheral surface 134 and the outer peripheral surface 135 of the guide 131, the inner wall surface 150 of the atomizer base member 102, the orifice 17 and the inner wall surface (the inner peripheral surface) of the heater 70. That is, the fuel spray 6 is promoted in the atomization and the gas-liquid mixing thereof under a condition in which it does not come into contact with the surrounding passage walls.

The atomizer of the external mixing type in this embodiment according to the present invention can be constructed by concentrically fitting the liquid fuel injector 9 and the injection valve holder 120 and the gas-liquid mixture injection nozzle 130 to the atomizer base member 102, which improves the productivity.

The liquid fuel injector 9, the atomizing gas passage 7, the gas-liquid mixture injection hole 12, the carrier gas passage 8, the inner peripheral surface 134 and the outer peripheral surface 135 of the guide 131, the inner wall surface 150 of the atomizer base member 102, the orifice 17 and the inner wall surface (the inner peripheral surface) of the heater 70 are arranged on a coaxial line.

As described above, the atomizing means of the liquid fuel injector 9 is achieved by providing a fuel passage adding velocity components in the axial direction (the direction of the center axis of the liquid fuel injector 9 or the direction of the injected spray) and the tangential direction to the injected fuel spray 6. The position of the passage wall surface surrounding the fuel spray 6 downstream of the liquid fuel injection hole of the liquid fuel injector 9 and the spray angle of the fuel spray 6 are set so that a gap may be formed between the passage wall surface and the outer periphery of the fuel spray 6. The passage wall surface is, for example, the downstream side portion of the gas-liquid mixture injection hole 12 in the gas-liquid mixture injection nozzle 130, the inner peripheral surface 134 inside the guide 131, the inner wall surface 159 of the atomizer base member 102, the inner wall surface of the orifice 17, the inner wall surface of the heater 70 or the like.

From another viewpoint, the cross section (diameter) of the passage of the fuel spray 6 in the range from the outlet (the downstream end) of the atomizing gas passage 7 to the outlet (the downstream end) of the carrier gas passage 8 is formed so as to be larger than the cross section (diameter) of the passage of the fuel spray 6 in the annular outlet opening portion of the atomizing gas passage 7. Otherwise, the cross section (diameter) of the passage of the fuel spray 6 in the range from the outlet (the downstream end) of the atomizing gas passage 7 to the outlet (the downstream end) of the carrier gas passage 8 is formed so as to be enlarged toward the downstream side.

This condition may be considered as a condition wherein an air layer is formed outside the outer edge of the fuel spray 6. This air layer is a layer having a very thin spray density compared to the spray density of the inside of the edge which is regarded as the outer edge of the fuel spray 6. By the effects of the atomizing air 10*a* and the carrier air 10*b*, the spray angle of the fuel spray 6 may sometimes become totally or partially smaller than the spray angle when the liquid fuel injector 9 is singly tested. Therefore, when the spray angle and the hole and each of the inner wall surfaces described above are set, the effects of the atomizing air 10*a* and the carrier air 10*b* should be taken into consideration.

Figure 3A:
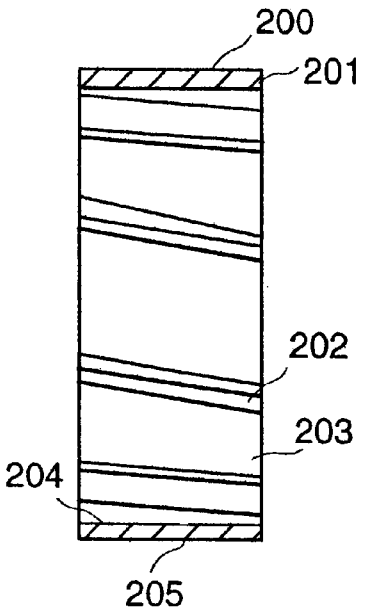
FIG. 3(*b*) is a plan view showing a carrying gas swirling member in the fuel supply device shown in FIG. 2 as seen from the direction of air flow, and FIG. 3(*a*) is a cross-sectional view taken on the plane of the line A—A of FIG. 3(*b*).
Figure 3B:
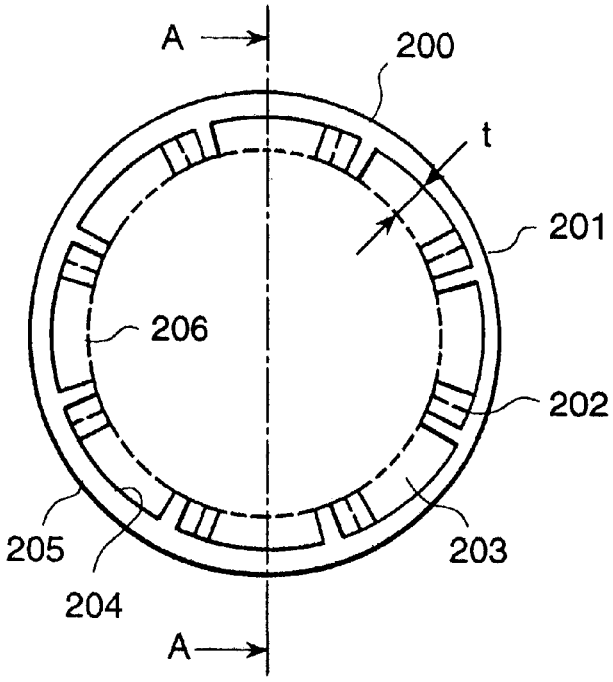
Figure 4A:
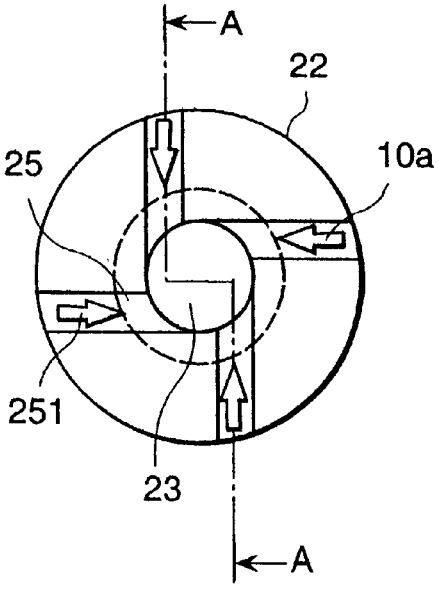
FIG. 4(*a*) is a plan view showing an atomizing gas swirling member in the fuel supply device shown in FIG. 2 as seen from the direction of air flow, and FIG. 4(*b*) is a cross-sectional view taken on the plane of the line A—A of FIG. 4(*a*)
Figure 4B:
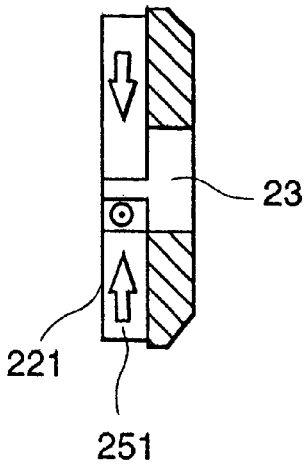

In this embodiment according to the present invention, a carrier gas swirl member 200 for imparting swirl to the carrier air 10*b* is arranged in the carrier gas passage 8, as shown in FIG. 2. The carrier gas swirl member 200 is composed of a cylinder portion 201 formed in a cylinder shape; and a plurality of fins 202 formed in one piece together with the cylinder portion 201, as shown in FIGS. 3(*a*) and 3(*b*). The fin 202 is formed so as to have a height t toward the inner side from the inner peripheral surface of the cylinder portion 201, and it is formed in a helical shape in the axial direction along the inner peripheral surface of the cylinder portion 201.

Referring to FIGS. 3(*a*) and 3(*b*), the outer wall surface 135 of the guide 131 of the gas-liquid mixture injection nozzle 130 is in contact with the portion shown by a broken line 206, so that the axially helical carrier gas passage 203 is formed by the outer wall surface 135 of the guide 131 and the fins 202 and the inner peripheral surface 204 of the cylinder portion 201. The carrier gas swirl member 200 is fixed by setting the outer peripheral surface 205 thereof in contact with the inner wall surface 150 of the atomizer base member 102.

The number of fins 202 may be only one if sufficient swirl force can be imparted to the carrier air 10*b*.

The carrier air 10*b* flowing into the carrier gas passage 203 is imparted with a swirl force as it passes through the inside of the carrier gas passage 203. The carrier air 10*b* is rotated to form a swirl. Since the fuel spray 6 is carried while being restricted by the carrier air 10*b* supplied with swirling in the mixed gas generating chamber 140 along the inner wall surface of the atomizer base member 102, the fuel spray 6 can be concentrated to the axial center portion (the central portion) of the passage to reduce the amount of fuel adhering onto the orifice 17 and the inner wall surface of the intake pipe.

In this embodiment, an atomizing gas swirl member 22 15 for imparting swirl to the atomizing air 10*a* is arranged in the atomizing gas passage 7, as shown in FIG. 2. The atomizing gas swirl member 22 is disposed on the surface of the atomizing gas passage 7 opposite to the front end surface 24*a* of the liquid fuel injection nozzle 24 of the liquid fuel injector 9. The front end surface 24*a* is in contact with the end surface 221 of the atomizing gas swirl member 22. A cylindrical hole 23 for allowing the fuel spray 6 and the atomizing air 10*a* to pass through is formed through the center of the atomizing gas swirl member 22.

Further, a plurality of grooves 251 in which the atomizing air 10*a* flows from the outer peripheral portion of the atomizing gas swirl member 22 toward the hole 23 are formed in the surface 221 of the atomizing gas swirl member 22. The direction of each of these grooves 251 is formed so as to extend in a direction eccentric to the central axis of the hole 23. Four grooves 251 are formed in this embodiment according to the present invention. Swirl passages 25 are formed by contacting the front end face 24*a* of the liquid injection nozzle 24 of the liquid fuel injector 9 to a part of portion near the hole 23 of the grooves 251 so that the swirling atomizing air 10*a* may be supplied to the hole 23. The broken line shown in FIG. 4(*a*) indicates the positional relationship of contact between the atomizing gas swirl member 22 and the front end surface 24*a* of the liquid injection nozzle 24 of the fuel injector 9.

The atomizing air 10*a* passes from the atomizing gas passage 7 through the swirl passages 25 formed by the grooves 251 of the atomizing gas swirl member 22. Since the atomizing air 10*a* collides with (merges with) the fuel spray 6 so as to eccentrically impart swirl to the fuel spray 6, it is possible to increase the atomization and the gas-liquid mixing of the fuel spray 6.

In the liquid fuel injector 9 of the upstream swirl type for injecting fuel by imparting a swirl to the fuel, the fuel spray 6 itself is injected so as to swirl. In order to increase the atomization and the gas-liquid mixing of the swirling fuel spray 6 as described above, it is better that the atomizing air 10*a* is caused to collide with the fuel spray 6 while the atomizing air 10*a* is swirling in a direction opposite to the swirl direction of the fuel spray 6 by constructing the swirl passage 25 of the atomizing gas swirl member 22 so as to inject the atomizing air 10*a* in a swirl direction opposite to the swirl direction of the fuel spray 6.

The carrier air lob may be blown into the intake assembling pipe 3 from the position and in the direction indicated by the arrow 10*b*', or the arrow 10*b*", as shown in FIG. 2. In order to introduce the carrier air lob into the intake assembling pipe 3 as shown by the arrow 10*b*', the intake bypass pipe 5*b* is connected to the side wall 3*a* of the intake assembling pipe 3 facing the intake pipe 5 from the direction across from the passage wall surface of the intake pipe 5.

On the other hand, in order to introduce the carrier air lob into the intake assembling pipe 3 as shown by the arrow 10*b*", the intake bypass pipe 5*b* is connected to the surface 3*b* of the intake assembling pipe 3 opposite to the fuel spray 6 in the injecting direction of the fuel spray 6. It is not always necessary that the carrier air 10*b*', 10*b*" is introduced perpendicularly to or parallel to the fuel spray 6 or the surface 3*a*, 3*b* of the intake assembling pipe 3. It is sufficient that the intake bypass pipe 5*b* is in communication with the intake assembling pipe 3 so as to merge with the fuel spray 6 with a predetermined angle taking the carrying efficiency of the fuel spray 6 into consideration.

By supplying the carrier air 10*b*', 10*b*" from the front of the fuel spray 6 so as to be opposite to the fuel spray 6, or from an opposite direction having an appropriate angle, the relative velocity of the collision between the fuel spray and the carrier air 10*b*', 10*b*" can be increased. Thereby, the carrier air 10*b*', 10*b*" can be actively used in promoting the atomization and the gas-liquid mixing of the fuel spray. Further, by supplying the carrier air 10*b*', 10*b*" to the intake assembling pipe 3, it is possible to reduce the amount of the fuel spray 6 adhering on the wall surface of the intake assembling pipe 3.

The relationship between the average droplet size of the fuel spray 6 to be supplied from the fuel supply device 100 to the internal combustion engine 1 and the amount of the atomizing air 10*a* will be described with reference to FIG. 5. The coordinate in the graph indicates the average droplet size of the fuel spray 6, and the average droplet size is a value at a position 60 mm downstream in the injection direction from the liquid injection hole of the fuel injector 9. The abscissa indicates the gas-to-liquid volumetric flow rate ratio (Qa/Ql), that is, the volumetric flow rate ratio (Qa) of the flow rate of the atomizing air 10*a* passing through the gas-liquid injection hole 12 to the flow rate (Ql) of the fuel spray injected from the fuel injector 9. The solid line in the graph indicates the relationship between the average droplet size and the gas-to-liquid volumetric flow rate ratio (Qa/Ql) under a pressure inside the intake pipe during idling operation of the internal combustion engine 1.

Figure 5:
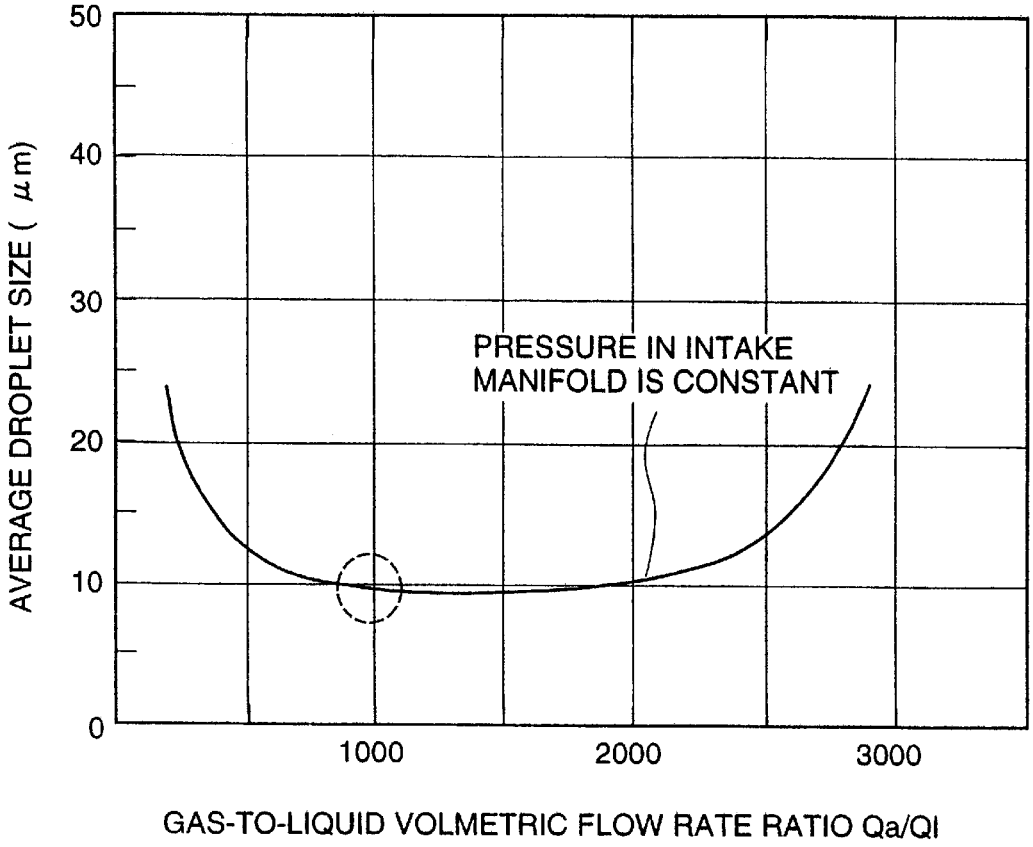
FIG. 5 is a graph showing the relationship between gas-to-liquid volumetric flow rate ratio and average droplet size of fuel spray when pressure in the intake pipe is kept constant.

As seen in FIG. 5, the amount of the atomizing air 10*a* is controlled by varying the area of the gas-liquid mixture injection hole 12 through which the atomizing air 10*a* passes under a constant pressure in the intake pipe. Further, the solid line in the graph was obtained by keeping the flow rate of fuel spray injected from the fuel injector 9 constant and varying only the flow rate of the atomizing air 10*a*.

There can be observed characteristics in which the average droplet size of the fuel spray 6 is decreased as the gas-to-liquid volumetric flow rate ratio is increased, that is, as the flow rate of the atomizing air 10*a* is increased, and in which the average droplet size becomes about 10 $\mu$m within a flow rate ratio range (Qa/Ql=nearly 700 to 2000) and the average droplet size becomes larger when the flow rate ratio exceeds the range. The above-mentioned characteristics are caused by the velocities of and the flow rates of the fuel spray 6 and the atomizing air 10*a* passing through the gas-liquid injection hole 12, and in addition by the positional relationship in supplying the fuel spray 6 and the atomizing air 10*a*.

From the result, this embodiment according to the present invention employs the range of the gas-to-liquid volumetric flow rate ratio of 1000 circled by the broken line where the average droplet size is the smallest and the gas-to-liquid volumetric flow rate ratio is as small as possible. By doing so, the flow rate of the atomizing air 10*a* can be reduced while the average droplet size of the fuel spray 6 is being kept to a value near 10 $\mu$m. Therefore, since the carrier air 10*b* passing through the carrier gas passage 8 can be further increased, the carrying power to the fuel spray 6 can be improved, and, accordingly, the amount of fuel adhering onto the wall surface of the intake pipe can be reduced.

According to the description provided in SAE99010792 "An Internally Heated Tip Injector to Reduce HC Emissions During Cold-Start", a fuel spray can be transported to a combustion chamber by being carried on a gas flow in an intake pipe when the average droplet size is nearly 20 $\mu$m. In this embodiment according to the present invention, the average droplet size is below nearly 20 $\mu$m even if the flow rate ratio Qa/Ql is within a range of 250 to 2750, and 30 to 40% of the amount of the fuel spray having a droplet size below 20 $\mu$m in the fuel spray can be transported to the combustion chamber.

Therefore, the amount of fuel adhering onto the wall surface of the intake pipe can be sufficiently reduced. The fuel spray not carried on the gas flow in the intake pipe passes through the inside of the heater 70 or collides with the heater 70 so as to be subjected to further atomization and vaporization. Thereby, the amount of fuel adhering onto the wall surface of the intake pipe can be reduced.

Figure 6:
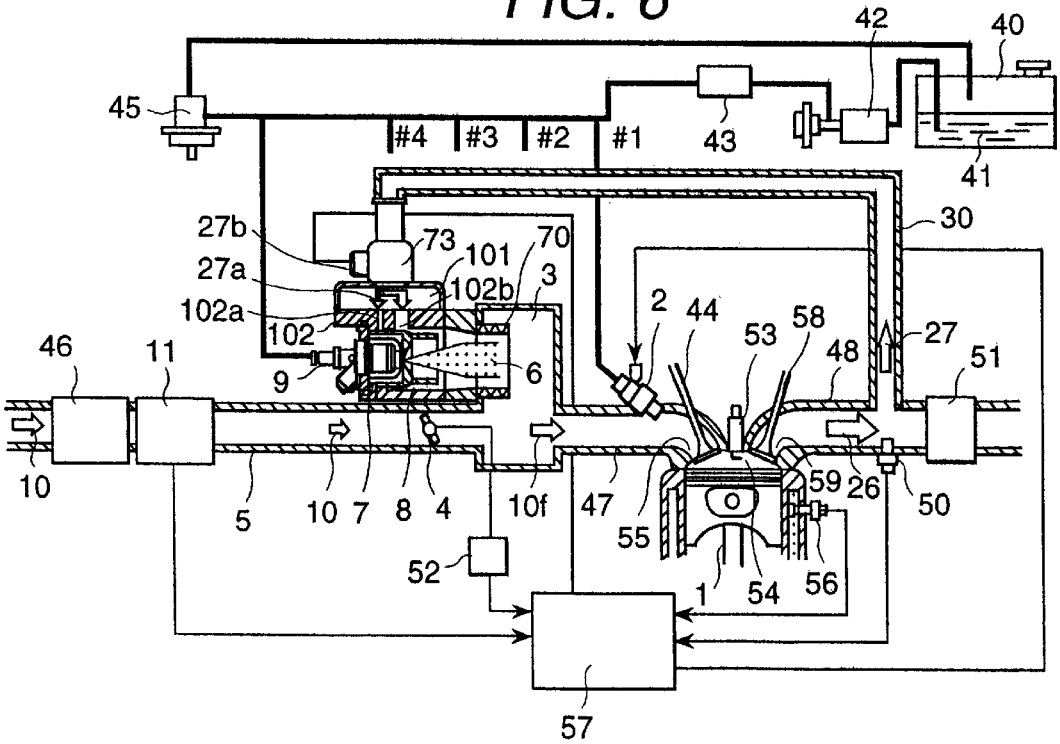
FIG. 6 is a schematic block diagram showing a second embodiment of an internal combustion engine mounting a fuel supply device in accordance with the present invention.

A second embodiment of the present invention will be described with reference to FIG. 6. The second embodiment uses gas obtained by exhaust gas recirculation (EGR) as an atomizing gas for promoting atomization of the fuel spray and also as a carrier gas for carrying the atomized fuel spray.

In the second embodiment, EGR gas 27, which represents part of the exhaust gas 26 exhausted from the internal combustion engine 1, is supplied to the atomizing gas passage 7 and the carrier gas passage 8 through an exhaust gas bypass pipe 30 as atomizing EGR gas 27*a* and carrying EGR gas 27*b*. Therefore, an inlet side (an upstream side end portion) of the exhaust gas bypass pipe 30 is in communication with the exhaust gas manifold 48, and an outlet side (a downstream side end portion) of the exhaust gas bypass pipe 30 is communicated with the atomizing gas passage 7 and the carrier gas passage 8 through the ISC valve 73 and the pressure regulation chamber 101.

The gas flow will be described. The EGR gas 27 to be supplied to an atomizing gas passage 102*a* and a carrier gas passage 102*b* of an atomizer base member 102 through the pressure regulation chamber 101 flows in a condition in which it is pressurized by the exhaust gas pressure. That is, the pressure on the intake manifold 47 side becomes a negative pressure due to operation of the internal combustion engine 1, and the pressure on the exhaust gas manifold 48 side becomes a positive pressure. Therefore, the pressurized EGR gas 27 is supplied to both of the gas passages 102*a* and 102*b*.

Since the constructions of the other parts, such as the atomizing gas passage 7, the carrier gas passage 8, etc., are similar to those in the first embodiment, the same reference characters are attached to the other parts and a repeated description thereof will be omitted.

The EGR gas 27 is high in temperature and in pressure compared to the intake air sucked from the outside because it is a gas that has just been exhausted. The heat and the pressure of the EGR gas 27 will effectively act to promote the atomization and vaporization of the fuel spray 6 injected from the second liquid fuel injector 9.

Although in this embodiment according to the present invention, control of the intake air 10 supplied to the internal combustion engine 1 is performed by controlling the opening and closing of the throttle valve 4, the intake air 10 can be controlled by a construction in which the upstream side and the downstream side of the throttle valve 4 are connected to each other using a bypass pipe, and an ISC valve is arranged in the bypass pipe.

Further, although the construction in this embodiment according to the present invention is such that EGR gas 27 is supplied to the atomizing gas passage 7 and the carrier gas passage 8, it is possible to employ a piping arrangement in which the EGR gas 27 is supplied to the carrier gas passage 8 and part of the intake air 10 is supplied to the atomizing gas passage 7, or in which the EGR gas 27 is supplied to the atomizing gas passage 7 and part of the intake air 10 is supplied to the carrier gas passage 8.

According to this embodiment of the present invention, the atomization and the vaporization of the fuel spray 6 can be promoted using the high-temperature and high-pressure EGR gas 27, and, accordingly, the burden on the heater 70 can be further reduced.

Figure 7:
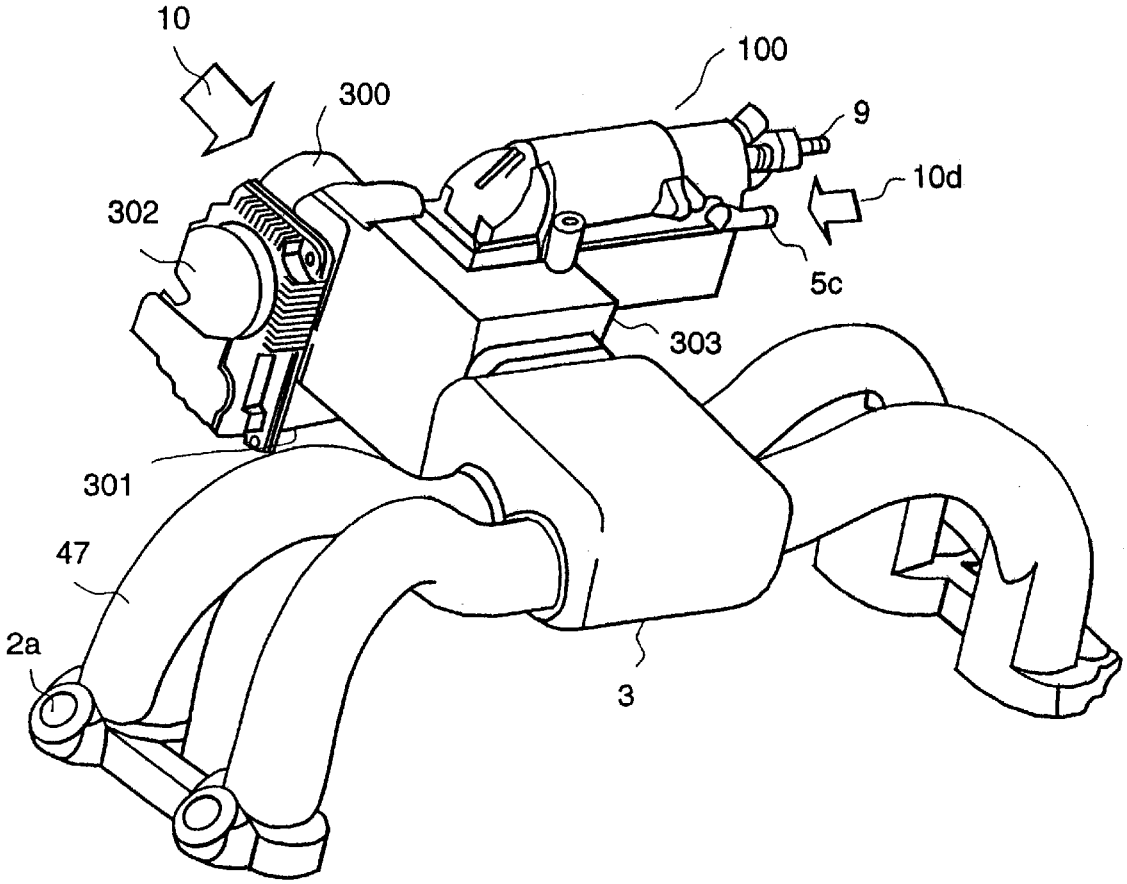
FIG. 7 is a perspective view showing a third embodiment of an internal combustion engine mounting a fuel supply device in accordance with the present invention.
Figure 8:
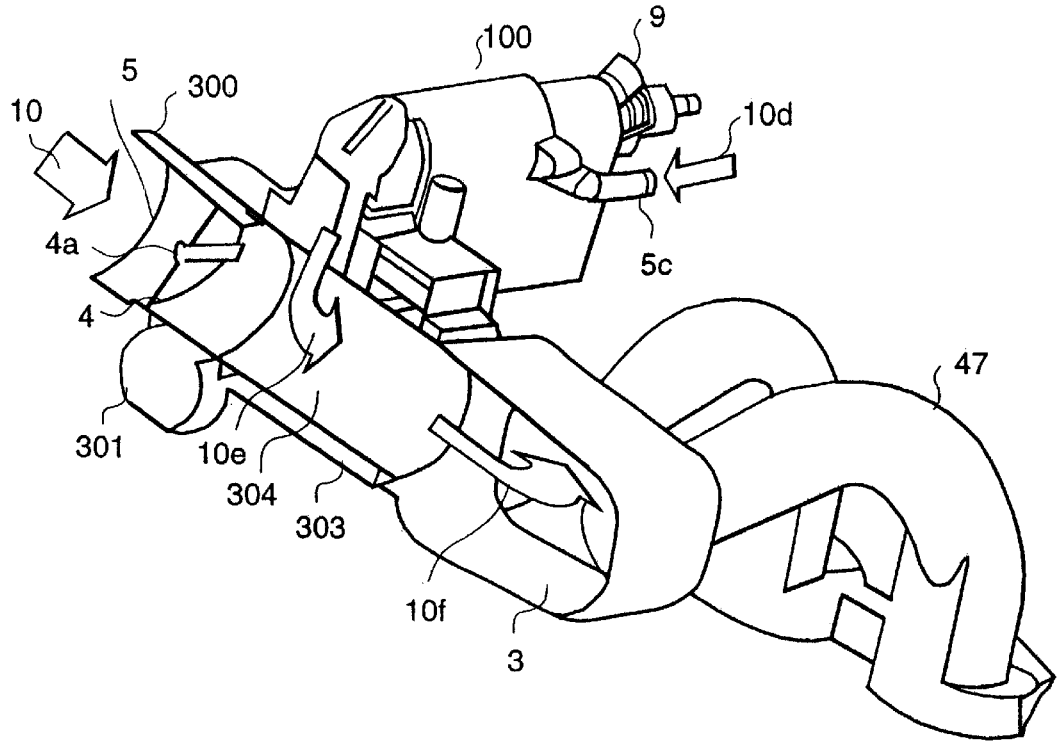
FIG. 8 is a partially cut-away perspective view showing the fuel supply device shown in FIG. 7.

A third embodiment in accordance with the present invention will be described with reference to FIG. 7 to FIG. 9. FIG. 7 is a perspective view showing the outer appearance of the fuel supply device 100, which has an intake passage portion 303 arranged between an electronic control throttle body 300 containing the throttle valve 4 and the intake assembling pipe 3 disposed upstream of the intake manifold 47. FIG. 8 is a perspective view partially in section showing the electronic control throttle body 300, the intake passage portions 303, the intake assembling pipe 3 and the intake manifold 47 in FIG. 7, which is cut at nearly the center along the intake passage 5 and along the plane vertical to the throttle valve shaft 4*a* arranged inside the electronic control throttle valve body 300.

The intake manifold 47 has fuel injector mounting portions 2*a* for mounting the first liquid fuel injectors 2 each corresponding to one of the cylinders.

The intake passage 5 and the intake assembling pipe 3 inside the electronic control throttle valve 47 are in communication with each other by way of the intake passage 304 inside the intake passage portion 303. Further, the fuel supply device 100 is connected to and communicates with the intake passage 304 of the intake passage portion 303 so that the mixed gas 10*e* produced by the fuel spray injected to from the second liquid fuel injector 9 disposed inside the fuel supply device 100 may be supplied to the intake passage 304 inside the intake passage portion 303. The mixed gas 10*e* supplied to the intake passage 304 flows into the intake assembling pipe 3 on the downstream side, and then passes through the intake manifold 47 so as to be efficiently supplied to each of the combustion chambers as the mixed gas 10*f* (the intake air and the fuel).

Although the structure in the third embodiment is such that the spray direction of the fuel spray injected from the fuel injector 9 inside the fuel supply device 100 is nearly perpendicular to the axial flow direction of the intake passage 5 inside the electronic control throttle body 300, it is possible to employ a structure in which the axial flow direction of the intake passage 5 is the same as the spray direction of the fuel spray injected from the fuel injector 9.

The electronic control throttle body 300 has the throttle valve 4 for controlling a desired amount of intake air corresponding to an operating condition of the internal combustion engine 1. That is, the amount of the intake air is controlled by the opening degree of the throttle valve 4. Further, the electronic control throttle body 300 comprises a driving motor 301 for controlling the amount of intake air by controlling the opening degree of the throttle valve 4; a drive mechanism for transmitting the power of the driving motor 301 in a throttle valve drive mechanism portion containing a cover 302; and a throttle positioning sensor 52 for detecting the opening degree of the throttle valve 4.

The intake bypass pipe 5*c* of the fuel supply device 100 is in communication with the intake passage 5 upstream of the throttle valve 4 in the electronic control throttle valve 300 by way of a bypass passage (not shown) to supply a part of the intake air 10 to the intake bypass pipe 5*c*.

It is preferable that an air control valve for controlling the air flow rate is provided in the bypass pipe communicating between the intake passage 5 upstream of the throttle valve 4 and the intake bypass pipe 5*c* in a case where the air flow rate is accurately controlled, or in a case where a control in which air is not supplied to the intake bypass pipe is performed.

Figure 9:
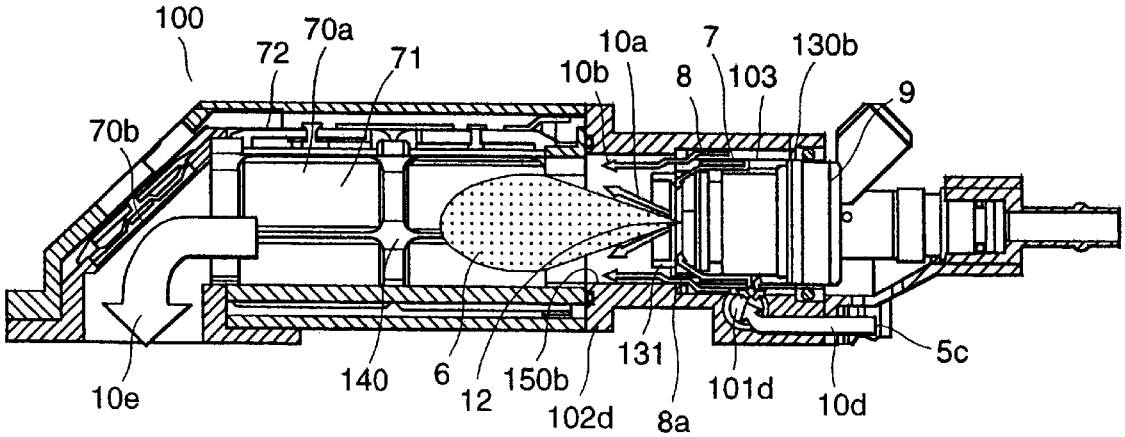
FIG. 9 is a vertical cross-sectional side view showing the atomizer portion of the fuel supply device shown in FIG. 7.

FIG. 9 is a vertical cross-sectional view showing the atomizer portion in the fuel supply device 100 shown in FIG. 7 and FIG. 8, which is cut along the spray direction of the fuel spray 6 injected from the liquid fuel injector 9.

The intake bypass pipe 5*c* communicates with the pressure regulation chamber 101*d* formed inside the atomizer base member 102*d*. The pressure regulation chamber 101*d* opens through the inner wall surface 150*b* of the atomizer base member 102*d* and communicates with the carrier gas passage 8 having the shape of an annular gap formed between the inner wall surface 150*b* and the outer wall surface of the gas-liquid mixture injection nozzle 130*b*. Further, the carrier gas passage 8 communicates with the mixed gas generating chamber 140 located downstream of the atomizer base member 102*d* through a carrier gas measurement part 8*a*.

Further, at least one or more opening portions of the nozzle passage 103 are bored in the side wall surface of the gas-liquid mixture injection nozzle 130*b* to provide communication between the inner and the outer wall surfaces of the gas-liquid mixture injection nozzle 130*b* through the nozzle passage 103. Further, the atomizing gas passage 7 having the shape of an annular gap is formed by the inner wall surface of the gas-liquid mixture injection nozzle 130*b* and the outer peripheral portion of the liquid fuel injector 9 and the front end surface of the liquid fuel injection nozzle.

The atomizing gas passage 7 communicates with the gas-liquid mixture injection hole 12 arranged on the downstream side in the injection direction of the liquid fuel injector 9, and the gas-liquid mixture injection hole 12 opens into the mixture generating chamber 140 on the downstream side of the atomizer base portion 102*c*.

The downstream portion of the mixture generating chamber 140 communicates with the intake passage 304 in the intake passage portion 303 downstream of the throttle valve 4.

In the heater portion 72 composing a part of the outer peripheral wall of the mixture generating chamber 140 arranged downstream of the atomizer base member 102*c* of the fuel supply device 100, a plurality of plate-shaped heaters (PTC heaters) 70*a* are arranged in a cylindrical shape along the inner wall surface so as to surround the outer edge of the fuel spray 6. Further, a plate-shaped heater 70*b* is arranged with a predetermined angle to the spray axis direction of the fuel spray 6 in the downstream portion of the mixed gas generating chamber 140. The mixed gas 10*e* is formed by efficiently vaporizing the fuel spray 6 using these heaters so as to be guided into the intake passage 304 downstream of the throttle valve 4.

The fuel supply device 100 as described above, causes the intake air 10*d* which has been diverted from the intake air 10 upstream of the throttle valve 4 to flow into the intake bypass pipe 5*c* through the bypass pipe (not shown) and then to flow into the pressure regulation chamber 101*d*. After that, a part of the intake air 10*d* introduced into the pressure regulation chamber 101*d* is guided as the carrier air 10*b* to the carrier air passage 8 constructed by a part of the inner wall surface 150*b* of the atomizer base member 102*d* and the outer wall surface of the gas-liquid mixture injection nozzle 130*b*, so as to be supplied to the mixed gas generating chamber 140*b* in such a way as to surround the fuel spray 6 injected from the liquid fuel injector 9.

On the other hand, the remainder of the intake air 10*d* flowing into the pressure regulation chamber 101*d* is guided as the atomizing air 10*a* into the atomizing gas passage 8 formed by the inner wall surface of the gas-liquid mixture injection nozzle 130*b* and the outer peripheral portion and the front end surface of the liquid fuel injector 9; and, this intake air 10*d* is efficiently supplied (collided) around nearly the whole periphery to the beginning end portion of the fuel spray 6 being injected from the liquid fuel injector 9, and then is made to pass through the gas-liquid mixture injection hole 12 so as to be supplied into the mixed gas generating chamber 140 disposed downstream of the gas-liquid mixture injection hole 12.

By this structure and the use of the atomizing air 10*a* and the carrier air 10*b*, the fuel spray 6 injected from the fuel injector 9 is efficiently atomized, and efficiently transported. Further, since the heaters 70*a* are cylindrically arranged along the outer periphery of the fuel spray 6, any large sized droplets in the outer side of the fuel spray 6 are efficiently atomized and vaporized when the fuel spray 6 passes through the mixed gas generating chamber 140, and the droplets including large droplets that are difficult to atomize and transport by the atomizing air 10*a* and the carrier air 10*b* can be vaporized when colliding with the heaters 70*a*.

Further, the heater 70*b* arranged at a predetermined angle relative to the injection direction of the fuel spray 6 injected from the fuel injector 9 can change the traveling direction of the fuel spray 6, and the mixed gas 10*e* produced from the fuel spray 6 can be efficiently supplied into the intake passage 304 on the downstream side of the throttle valve 4. Thus, the fuel spray 6 can be efficiently transported to the intake manifold 47 through the inside of the intake assembling pipe 3 downstream of the intake pass-age 304 and further to each of the combustion chambers (not shown in the figure).

The effects common to the above-described embodiments will be described with reference to FIG. 10(*a*), FIG. 10(*b*) and FIG. 10(*c*).

Figure 10A:
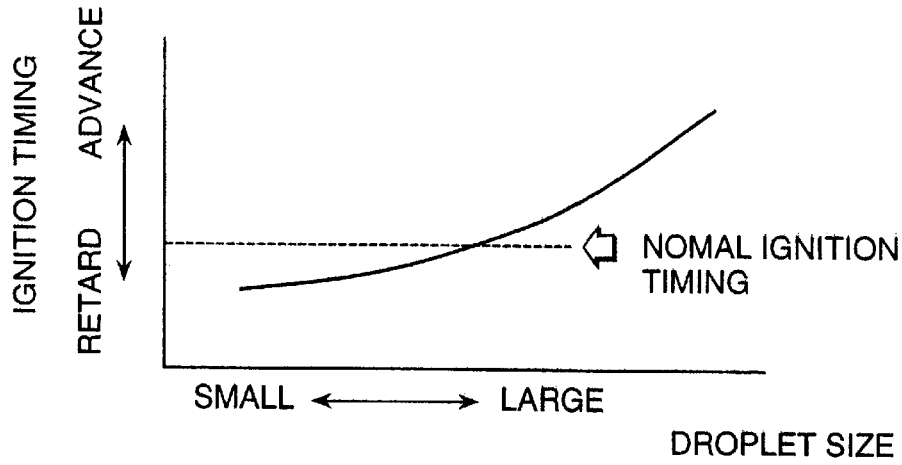
FIG. 10(*a*), FIG. 10(*b*) and FIG. 10(*c*) are graphs illustrating effects of atomization of fuel spray on the cleaning of exhaust gas.
Figure 10B:
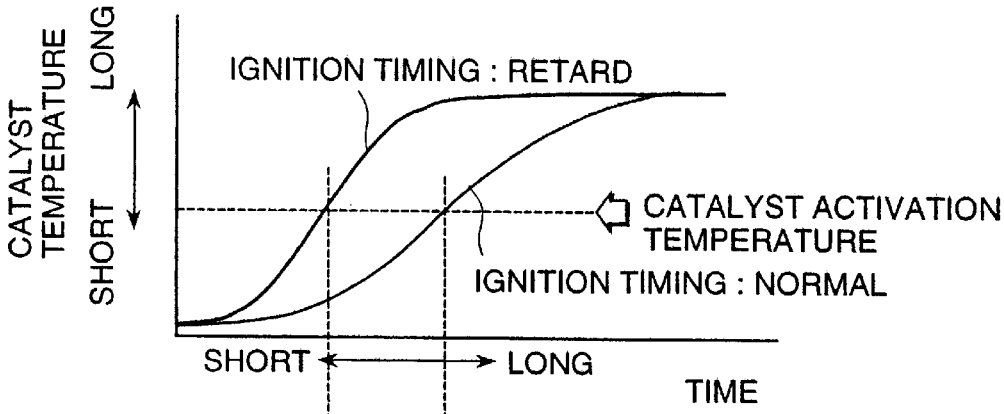
Figure 10C:
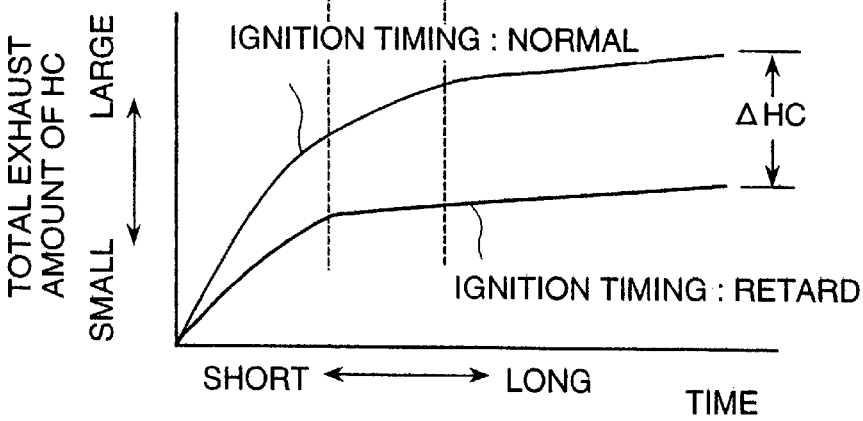

In FIG. 10(*a*), the ordinate indicates ignition timing and the abscissa indicates droplet size of the fuel spray supplied from the fuel supply device 100. In FIG. 10(*b*), in which the ordinate indicates catalyst temperature and the abscissa indicates time, the thin line shows the relationship between catalyst temperature and time when the ignition timing of the internal combustion engine is normal, and the bold line shows the relationship between catalyst temperature and time when the ignition timing of the internal combustion engine is retarded. In FIG. 10(*c*), in which the ordinate indicates total amount of exhausted HC and the abscissa indicates time, the thin line shows the relationship between the total amount of exhausted HC and the time when the ignition timing of the internal combustion engine is normal, and the bold line shows the relationship between total amount of exhausted HC and the time when the ignition timing of the internal combustion engine is retarded.

The intake air 10*a* or the EGR gas 27 is controlled by controlling the ISC valve 73 at the time of a cold start or normal-temperature start, and part of the atomizing air 10*a* or the atomizing EGR gas 27*a* is caused to collide with the fuel spray 6 around the whole periphery so as to be opposite to each other. Thereby, the atomization and the gas-liquid mixing of the fuel spray 6 are promoted. Then, in order to suppress the fuel spray 6 from adhering onto the inner wall surface of the intake pipe, a flow of the carrier gas 6 or the carrier EGR gas 27*b* for carrying the fuel spray 6 is provided, and, further, the heaters 70 are arranged in the downstream portion. Thereby, the atomization and the mixing of the air and fuel and the vaporization thereof can be promoted to reduce the amount of the fuel spray adhering onto the wall surface.

The reason for this is as follows. The vaporization of the fuel spray 6 can be accelerated by atomization of the fuel spray 6 to increase the surface area per unit fuel mass, and the property of the fuel spray 6 following the air flow inside the intake manifold 47 is improved, and a flow for confining the atomized fuel spray 6 is formed. Therefore, the amount of the fuel adhering onto the inner wall surface can be reduced. Further, by reducing the amount of fuel adhering onto the wall surface, the starting performance and the fuel economy of the internal combustion engine 1 can be improved, and, in addition, the exhaust gas cleaning performance can be also improved.

Further, by promoting the atomization, the gas-liquid mixing and the vaporization of the fuel spray 6 to be supplied to the internal combustion engine 1, the ignition timing of the internal combustion engine 1 can be retarded while still maintaining the stability of combustion, as shown in FIG. 10(*a*).

By retarding the ignition timing compared to the normal condition, high-temperature exhaust gas not performing expansion work can be produced, and the catalyst temperature of the ternary catalyst converter 51 can be increased up to a high temperature in a short time using the high-temperature exhaust gas, as shown in FIG. 10(*b*). In the graph, the horizontal dotted line indicates the catalyst activation temperature, and the catalyst temperature can be increased up to the catalyst activation temperature in a short time by heating the catalyst using the high temperature exhaust gas.

By activating the catalyst of the ternary catalyst converter 51 in a short time, the total amount of exhausted HC can be substantially reduced during the starting operation of the internal combustion engine 1 compared to in the case of normal ignition timing, as shown in the graph of FIG. 10(*c*). Further, due to the warming-up of the ternary catalyst converter in a short time, the amount of exhausted NOx and Co, in addition to HC, can be also reduced.

As described above, by promoting the atomization and the gas-liquid mixing and the vaporization of the fuel spray 6 injected from the fuel injector 9, the amount of fuel adhering onto the inner wall surface of the intake pipe can be reduced, and the cold start and normal-temperature performance of the internal combustion engine can be improved, and the fuel economy can be improved, and further the exhaust gas cleaning performance can be improved.

Although a construction using the heater 70 is provided in the embodiments described above, the present invention can be applied to a construction in which the heater 70 is eliminated if the atomization, the gas-liquid mixing and the vaporization by the atomizing gas and the carrier gas are sufficiently performed.

Although each of the embodiments described above according to the present invention has been explained by reference to what is called a port injection engine which has a first fuel injector 2 for injecting fuel for each of the cylinders into the intake manifold 47, the same effects can be attained by applying the present invention to what is called an in-cylinder injection type internal combustion engine (the direct fuel injection type internal combustion engine) in which fuel is directly injected into the combustion chamber.

According to the present invention, since the amount of fuel adhering onto the wall surface can be reduced by promoting the atomization and the gas-liquid mixing of the fuel spray injected from the liquid fuel injector, the starting performance and the fuel consumption of the internal combustion engine can be improved, and the exhaust gas purification can be also improved. In addition, since a heater is used as an auxiliary device, the burden of the heater is reduced, and the electric energy consumed by the heater can be made small or the heater can be eliminated in some cases. Further, by reducing the electric energy consumed by the heater, the reliability and the durability of the heater can be improved.

What is claimed is:

1. A fuel supply device comprising a fuel atomizing device for atomizing fuel spray injected from a liquid fuel injector by an action of gas, said atomized fuel spray being supplied in a downstream of a throttle valve in an intake pipe having said throttle valve, wherein the fuel supply device comprises:

a first gas passage for jetting atomizing gas which acts on said fuel spray injected from a liquid fuel injection hole of said fuel injector to promote atomization of said fuel spray, said first gas passage being opened around said liquid fuel injection hole;

a second gas passage for generating a mixed gas by jetting a carrying gas to said fuel spray so as to surround around said fuel spray of which atomization is promoted by said atomizing gas; and a heater disposed so as to be positioned in the periphery of a carrying passage of said mixed gas.

2. A fuel supply device according to claim 1, wherein an average droplet size of said fuel spray is smaller than 20 $\mu$m.

3. A fuel supply device according to claim 1, wherein said fuel atomizing device sets a ratio Qa/Ql of an amount of atomized gas Qa to an amount of injected fuel Ql to a value in a range of 250 to 2750.

4. A fuel supply device according to any one of claim 1 to claim 3, wherein said liquid fuel injector in said fuel atomizing device comprises a fuel passage which imparts velocity components in an axial direction and in a tangential direction to said injected fuel.

5. A fuel supply device according to claim 4, wherein said first gas passage is formed so as to have a front end surface of said fuel injector as a part of a wall of said first gas passage.

6. A fuel supply device according to claim 1, wherein said first gas passage is a gas passage which annular opens around a central axis passing through a center of said liquid fuel injection hole of said fuel injector and being virtually directed in a direction of injecting said fuel spray, and lets said gas flow toward said liquid fuel injection hole in a direction across said central axis, and said second gas passage is a gas passage which has an annular opening directed toward said direction of injecting said fuel spray around said central axis.

7. A fuel supply device according to claim 1, wherein a flow rate of the carrying gas flowing through said second gas passage is larger than a flow rate of said atomized gas flowing through said first gas passage.

8. A fuel supply device according to claim 1, wherein said first gas passage and said second gas passage are formed in that end portions of said gas passages in the upstream side are commonly constructed as one gas passage branched from an intake pipe in said upstream side of said throttle valve, and said one gas passage is branched into two passages in said downstream side.

9. A fuel supply device according to claim 1, wherein at least one upstream side end portion of the gas passage between said first gas passage and said second gas passage is connected to an exhaust pipe of an internal combustion engine.

10. An internal combustion engine comprising a fuel supply device according to claim 1.

* * * * *